US006661991B2

(12) United States Patent
Naito et al.

(10) Patent No.: US 6,661,991 B2
(45) Date of Patent: Dec. 9, 2003

(54) INDUCTION HEATING AND FIXING DEVICE FOR FIXING TONER ON A RECORDING MEDIUM IN AN IMAGE FORMING APPARATUS

(75) Inventors: Yoshikazu Naito, Osaka (JP); Akira Takasu, Osaka (JP); Takahiro Tsujimoto, Osaka (JP); Kiyohito Tsujihara, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/059,223

(22) Filed: Jan. 31, 2002

(65) Prior Publication Data

US 2002/0103614 A1 Aug. 1, 2002

(30) Foreign Application Priority Data

Feb. 1, 2001 (JP) ..... 2001-025591

(51) Int. Cl.[7] ..... G03G 15/20; H05B 6/40
(52) U.S. Cl. ..... 399/328; 219/619
(58) Field of Search ..... 399/69, 328, 330, 399/334, 336; 219/216, 619

(56) References Cited

U.S. PATENT DOCUMENTS 4,570,044 A 2/1986 Kobayashi et al. ..... 219/619
5,822,669 A 10/1998 Okabayashi et al. ..... 399/330
6,195,525 B1 * 2/2001 Maeyama ..... 399/328
6,320,168 B1 * 11/2001 Kimata et al. ..... 399/330 X
6,336,027 B1 * 1/2002 Sakai et al. ..... 399/328
6,341,211 B1 * 1/2002 Tsujimoto et al. ..... 399/330
6,498,324 B2 * 12/2002 Yamamoto et al. ..... 219/619 X

FOREIGN PATENT DOCUMENTS

JP 10-31379 * 2/1998
JP 10-207278 8/1998

* cited by examiner

*Primary Examiner*—Fred L Braun
(74) *Attorney, Agent, or Firm*—Morrison & Foerster LLP

(57) ABSTRACT

An induction heating and fixing device includes a hollow cylindrical fixing member, a core for forming a closed magnetic circuit, a ring member formed of magnetic material and provided on the core in the vicinity of the bilateral ends of the fixing member, a coil wound around the core, and a pressure member disposed so as to press against the fixing member. This device suppresses temperature drop at the bilateral ends of the fixing roller and maintains uniform temperature distribution in the axial direction of the fixing roller by leaving the device open at both bilateral ends.

19 Claims, 4 Drawing Sheets

INDUCTION HEATING AND FIXING DEVICE FOR FIXING TONER ON A RECORDING MEDIUM IN AN IMAGE FORMING APPARATUS

RELATED APPLICATION

The present invention is based on Japanese Patent Application No. 2001-25591, the content of which is hereby incorporated by reference.

BACKGROUND OF THE INVENTIOJN

1. Field of the Invention

The present invention relates to an induction heating and fixing device for fixing toner on a recording medium in image forming apparatuses such as copiers, printers, and facsimile machines.

2. Description of the Related Art

In recent years fixing devices using the induction heating method have been used as fixing devices in image forming apparatuses.

For example, U.S. Pat. No. 4,570,044 discloses an induction heating and fixing device wherein a part of an iron core forming a closed magnetic circuit is inserted into the hollow space within a cylindrical fixing roller heated by induction, and a coil is wound around the iron core to generate a magnetic field, such that the fixing roller is heated when an alternating current flows through the coil.

Disadvantages arise, however, in that since this induction heating and fixing device is closed at both ends of the fixing roller heated by induction, the temperature distribution in the axial direction of the fixing roller produces a higher temperature in the center area and lower temperature at both ends due to the greater radiant heat at the ends which easily reduces the temperature and causes a large temperature gradient between the center part and the end parts.

SUMMARY

An object of the present invention is to provide an induction heating and fixing device which suppresses temperature drop at the bilateral ends of the fixing roller, and maintains uniform temperature distribution in the axial direction of the fixing roller.

The present invention relates to an induction heating and fixing device comprising:

- a hollow cylindrical fixing member heated by induction;
- a core for forming a closed magnetic circuit, a part of the core being inserted onto the hollow cylindrical fixing member;
- a ring member formed of magnetic material and provided on the core in the vicinity of the bilateral ends of the hollow cylindrical fixing member;
- a coil wound around the core; and
- a pressure member disposed so as to press against the hollow cylindrical fixing member.

DESCRIPTION OF THE PREFERRED EMBODIMENT

The embodiments of the present invention are described hereinafter with reference to the accompanying drawings.

Figure 1:
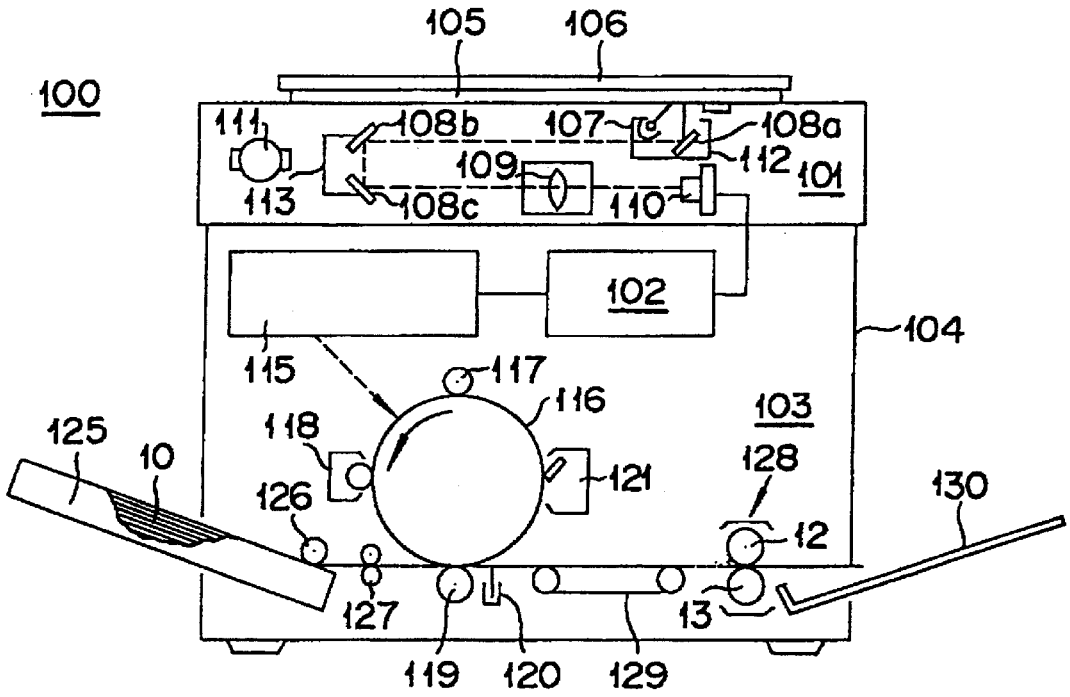
FIG. 1 is a brief structural view of a copier incorporating the induction heating and fixing device of the present invention.

FIG. 1 is a brief structural view of a copier as an image forming apparatus incorporating the induction heating and fixing device of the present invention.

As shown in the drawing, a copier 100 of an embodiment of the present invention has an image scanning unit 101 for reading a document image, a signal processing unit 102 for executing signal processing, a printer unit 103 for printing on a sheet an image read by the image scanning unit 101, and a casing 104 for layout and housing each of these units.

In the image scanning unit 101, a document placed upon a glass platen 105 is pressed down by a platen cover 106, however, when an automatic document feeder is installed, the automatic document feeder replaces the platen cover 106.

A document placed on the glass platen 105 is illuminated by a lamp 107, and the light reflected by the document is directed by mirrors 108*a,* 108*b,* 108*c,* and condenser lens 109 and forms an image on a line image sensor 110, which converts the light image to image information and transfers this information to the signal processing unit 102. A first slider 112 is mechanically moved at a speed V, and a second slider 113 is mechanically moved at a speed V/2 in a perpendicular direction (subscan direction) relative to the electrical scanning direction (main scan direction) of the image sensor via the drive of a scanner motor 111, so as to scan the entire surface of a document.

The signal processing unit 102 is provided with a laser generator 115, and a photosensitive drum 116 as an image-carrying body; and arranged around the periphery of the rotating photosensitive drum 116 are a charging roller 117 as a charging device, developing device 118, transfer roller 119 as a transfer device, discharge needle 120 as a sheet 10 discharger and separation device, and cleaning device 121 for removing residual toner from the surface of the photosensitive drum 116.

The laser generator 115 modulates a semiconductor laser in accordance with the level of the image signal sent from the signal processing unit 102. The laser light is directed by a polygonal mirror, f-θ lens, and deviating mirror not shown in the drawing, and illuminates the photosensitive drum 116 at a position between the charging roller 117 and the developing device 118. The electrostatic latent image formed on the surface of the photosensitive drum 116 is developed by toner in the developing device 118.

On the other hand, a plurality of sheets 10 are stacked in a paper cassette 125 removably mounted in the casing 104. The sheets 10 within the paper cassette 125 are fed sheet by sheet via a feed roller 126, and transported toward a transfer position between the photosensitive drum 116 and the transfer roller 119 by a timing roller 127 with a specific timing.

An image developed on the surface of the photosensitive drum 116 is transferred onto the sheet 10 by the transfer roller 119. After transfer, the sheet 10 is separated from the photosensitive drum 116 and transported by a transport belt 129 toward a fixing device 128.

The sheet 10 is transported to the induction heating and fixing device 128, and the unfixed toner transferred onto the sheet 10 is fixed by the induction heating and fixing device, whereupon the sheet 10 bearing the fixed toner is ejected to a discharge tray 130.

When the transfer of the image to the sheet 10 by the transfer roller 119 is completed, the surface of the photosensitive drum 116 is charged to a negative polarity by a pre-cleaning charger not shown in the drawing, the residual toner is removed by the cleaning device 121, and the residual charge is then removed by an eraser. Thereafter, the surface of the photosensitive drum 116 is again charged by the charging roller 117, subjected to latent image formation by the laser light, the formed latent image is developed by the developing device 118, and the charge of the non-image region is discharged by the pre-cleaning eraser not shown in the drawing.

Figure 2:
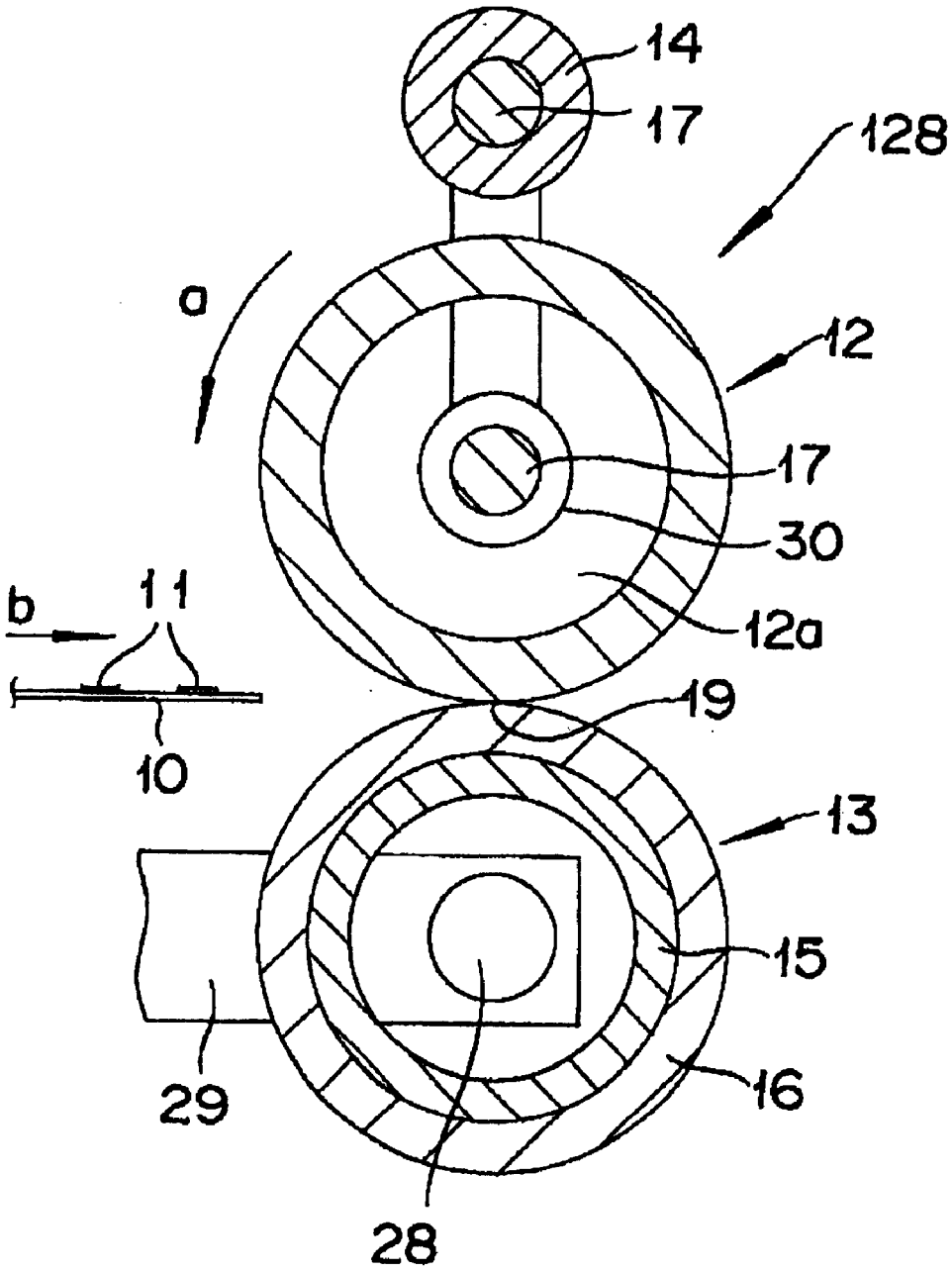
FIG. 2 is a brief cross section view showing the main part of the induction heating and fixing device of FIG. 1.
Figure 3:
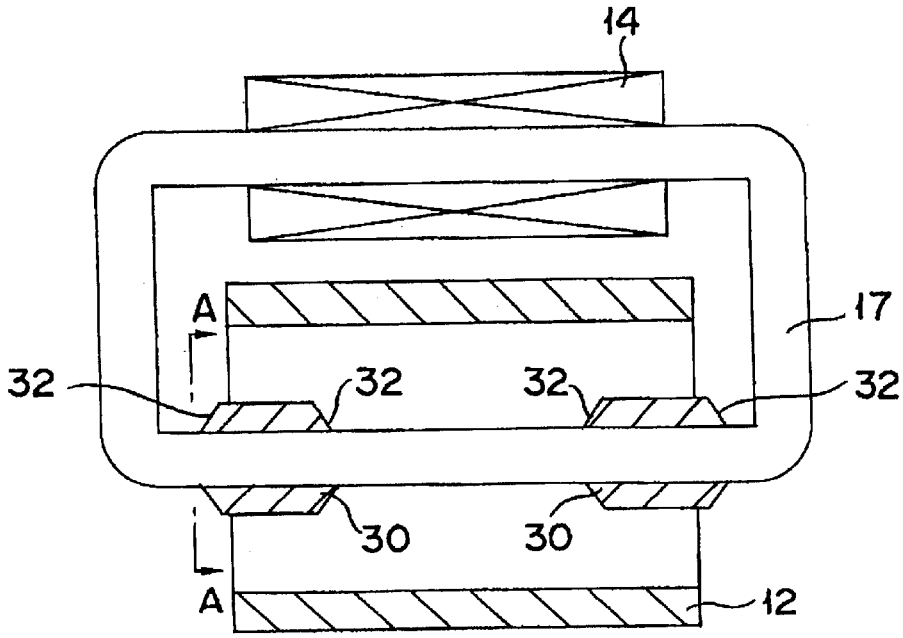
FIG. 3 briefly shows the iron core of the induction heating and fixing device.
Figure 4:
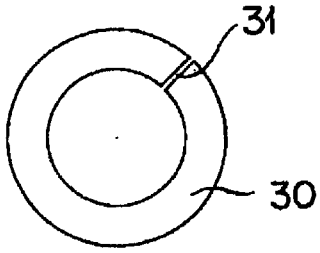
FIG. 4 is a side view of the ring member provided on the iron core.
Figure 5:
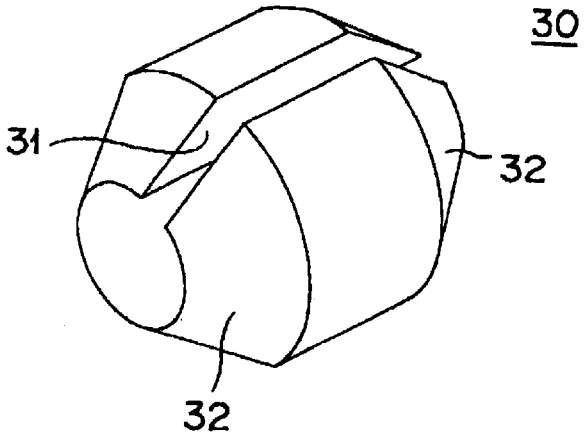
FIG. 5 is a perspective view of the ring member provided on the iron core.

FIG. 2 is a brief cross section view of the main part of the fixing device of FIG. 1, and FIG. 3 briefly shows the iron core of the fixing device.

First, referring to FIG. 2, the induction heating and fixing device 128 is a fixing device which thermally fuses a toner 11 maintained on the surface of a sheet 10 so as to fix the toner onto the sheet 10, and is provided with an induction-heated fixing roller 12, a pressure roller 13 which presses against the fixing roller 12, and a coil 14 for inductively heating the fixing roller 12.

The fixing roller 12 is mounted so as to be powered to rotate in the arrow "a" direction in FIG. 2, and the pressure roller 13 is driven in rotation in conjunction with the rotation of the fixing roller 12.

The fixing roller 12 is a conductive pipe having the shape of a hollow cylinder, e.g., a carbon steel tube, stainless steel alloy tube, or aluminum tube, or formed of iron or the like, and has a wall thickness sufficient to ensure thermal capacity within a range capable of ensuring sufficient mechanical strength relative to the pressure force received from the pressure roller 13. The exterior surface of the roller is coated with a fluororesin for ease of separation of the sheet 10 and this coating forms a release layer having excellent release characteristics relative to the toner as well as excellent heat resistance.

The fixing roller 12 has a drive gear not shown in the drawing mounted at one end, and is rotated by a power source not shown in the drawing such as a motor or the like connected to this drive gear.

The pressure roller 13 comprises a shaft core 15, and a silicone rubber layer 16 formed on the exterior surface of the shaft core 15. The silicone rubber layer 16 is a rubber layer having heat resistance and release characteristics for easy separation of the sheet 10 from the surface of the roller. In the mode shown in the embodiment in the drawing, a halogen lamp 28 is installed within the shaft core 15.

The pressure roller 13 is pressed toward the fixing roller 12 by a spring not shown in the drawing, so as to form a nip 19 through which the sheet 10 passes in the contact region with the fixing roller 12.

The induction heating and fixing device 128 has an iron core 17 in a rectangular shape forming a closed magnetic circuit, and part of this iron core 17 is inserted into the hollow center part 12*a* within the fixing roller 12, as shown in FIG. 3. A coil 14 is wound around the iron core 17. The coil 14 is connected to a power source not shown in the drawing.

The iron core 17 may be such as is normally used in a transformer, e.g., it is desirable that the iron core 17 has a high magnetic permeability such as a silicon steel plate laminate iron core. A normal single wire having on its surface an adhesion layer and an insulation layer may be used as the coil 14.

A ring member 30 which is thicker than the magnetic circuit is provided on the iron core 17 in the vicinity of the bilateral ends in the axial direction (length direction of the iron core) of the fixing roller 12.

The ring member 30 is formed of a magnetic material such as ferrite, pure iron, silicon steel or the like, and part of the ring member 30 is segmented with a slit 31 in one part. Furthermore, the ring member 30 is formed with a taper 32 at both ends.

Figure 6:
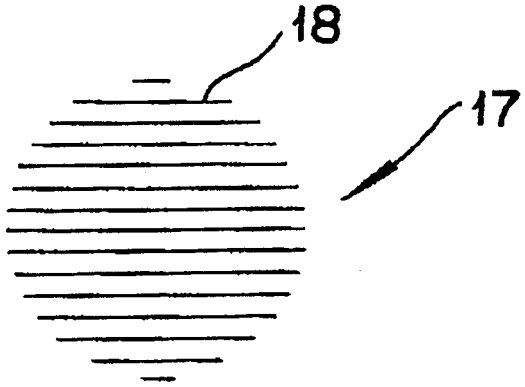
FIG. 6 is a cross section view along the A—A line shown in FIG. 3.

The iron core 17 has an approximately circular cross section shape formed by the laminate layers of the silicon steel plate 18, as shown in FIG. 6, for fitting the ring member 30. FIG. 6 is a cross section view along the A—A line shown in FIG. 3.

The fixing operation in a copier having the above-described structure is started when the copier 100 is turned ON (or standby is cancelled), whereupon an alternating current of approximately 50~60 Hz is applied to the coil 14 from a power circuit (not shown in the drawing) until the temperature of the fixing roller 12 is heated to a suitable fixing temperature (e.g., 150~200° C.) by induction heating.

Then, when a copy start key (not shown in the drawing) is pressed on the copier 100, a document image is read and the transport of a sheet 10 is started from the paper cassette 125. In this way, a sheet 10 bearing the unfixed toner 11 is transported from the left as indicated by the arrow "b" in FIG. 2, and fed toward the nip 19 in the contact part between the fixing roller 12 and the pressure roller 13.

The sheet 10 is transported through the nip 19 while receiving the heat of both the heated fixing roller 12 and the pressure roller 13 and the pressure exerted by the pressure roller 13. In this way, the unfixed toner 11 is fixed on the surface of the sheet 10 to form a fixed toner image on the sheet 10. Of the two sides of the sheet 10, the toner 11 is maintained on the side of the sheet 10 which contacts the fixing roller 12. The sheet 10 which has passed through the nip 19 naturally separates from the curvature of the fixing roller 12 by the resilience/stiffness of the sheet itself, and is transported to the right in FIG. 2. This sheet 10 is transported by a discharge roller and ejected onto a discharge tray 130.

The effects of the embodiment are described below.

The temperature distribution of the fixing roller 12 is normally lower at the bilateral end parts. When the coil 14 is provided on the exterior of the fixing roller 12 as in the present embodiment, the temperature drop at the bilateral end parts becomes greater. The ring member 30 is provided to suppress the temperature drop at the bilateral end parts of the fixing roller 12.

The magnetic bond between the fixing roller 12 and the iron core 17 is increased near the bilateral ends of the fixing roller by providing the ring member 30 on the iron core 17 near the end parts of the fixing roller, thereby increasing the induced electromotive force generated at the bilateral ends of the fixing roller 12 so as to be greater than the induced electromotive force generated at other part of the fixing roller 12. For this reason, the induction current flowing within the fixing roller 12 is greater near the bilateral ends of the fixing roller 12 than at the other part of the fixing roller 12 even when the wall thickness of the fixing roller 12 is uniform, and the temperature rise near the bilateral end parts of the fixing roller 12 is also greater than at the other part of the fixing roller 12. Accordingly, the temperature drop near the bilateral end parts of the fixing roller 12 is corrected, and the temperature distribution is uniform in the axial direction of the fixing roller 12.

The taper 32 provided at both ends of the ring member 30 increases the magnetic bond between that part and the fixing roller 12 such that the magnetic field generated within the iron core 17 which forms a closed magnetic circuit readily enters the ring member 30.

Furthermore, providing the slit 31 in the ring member 30 along the axis of the fixing roller 12 to segment the ring eliminates conductivity in the ring member 30 in directions intersecting the magnetic field generated in the iron core 17. In this way, the flow of induction current in the ring member 30 is prevented, thereby preventing the ring member 30 from generating heat. Accordingly, energy loss is prevented by providing the ring member 30.

In the present embodiment, the cross section of the iron core 17 has an approximately circular shape, thereby increasing the contact surface area between the iron core 17 and the ring member 30, and increasing the magnetic bond. A cross section approximately circular in shape may be provided, for example, by cutting after the iron core has been formed by laminating the silicon steel plates 18. This cross section shape of the iron core 17 is not limited to a laminated iron core, and also may be applied to an iron core formed as an integrated single part.

Although the present invention has been described by way of the embodiments mentioned above, the present invention is not limited to these embodiments.

Figure 7:
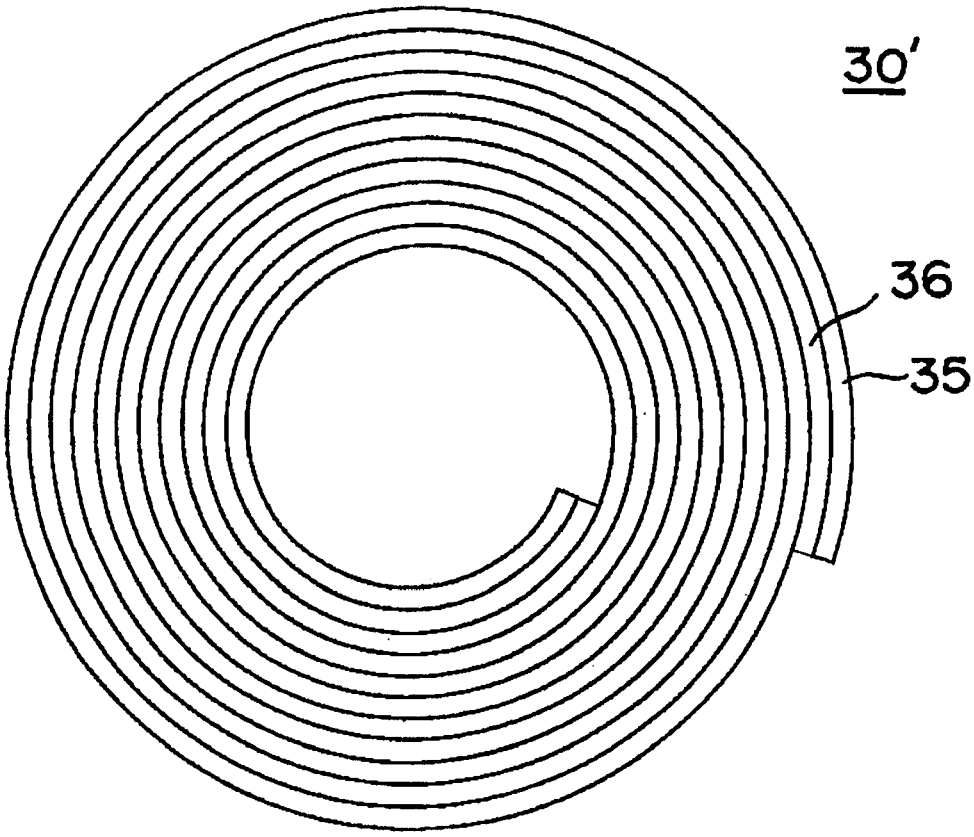
FIG. 7 shows the condition of a band-like silicon steel plate shaped in a spiral as another mode of the ring member provided on the iron core.

For example, a band-like silicon steel plate 35 may be wound in a spiral shape and used as a ring member 30', as shown in FIG. 7. In this case, the spirally wound silicon steel plate 35 is provided with an insulation layer 36 to prevent the windings from making mutual contact. In this way, an induction current is prevented from flowing in the spiral-shaped wound silicon steel plate 35 in a direction intersecting the magnetic field generated within the iron core. The insulation layer 36 may be a space such that the windings of the silicon steel plate 35 do not make mutual contact, or an insulation material may be wrapped around the silicon steel plate 35. The example shown in FIG. 7 provides a space as the insulation layer 36.

Furthermore, while the cross section of the iron core is approximately circular in the above embodiments to increase the contact surface area between the iron core and the ring member, the present invention is not limited to a circular shape inasmuch as a multisided shape also may be used.

Moreover, while a copier has been used as an example of an image forming apparatus in the above embodiments, the present invention is not limited use in a copier, inasmuch as the present invention may be suitably adapted for use as the fixing device in various image forming apparatuses such as, for example, printers, facsimile machines and the like.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An induction heating and fixing device comprising:

a hollow cylindrical fixing member heated by induction;

a core for forming a closed magnetic circuit, a part of the core being inserted onto the hollow cylindrical fixing member;

a ring member formed of magnetic material and provided on the core in the vicinity of the bilateral ends of the hollow cylindrical fixing member;

a coil wound around the core; and a pressure member disposed so as to press against the hollow cylindrical fixing member.

2. The induction heating and fixing device of claim 1, wherein the ring member has a slit.

3. The induction heating and fixing device of claim 2, wherein the slit is provided along the axial direction of the fixing member.

4. The induction heating and fixing device of claim 1, wherein the magnetic material is at least one material selected from the group consisting of ferrite, pure iron and silicon steel.

5. The induction heating and fixing device of claim 1, wherein the ring member comprises a magnetic material layer and an insulation layer and is formed in a spiral shape.

6. The induction heating and fixing device of claim 1, wherein the ring member has a taper at both end in the axial direction of the fixing member.

7. The induction heating and fixing device of claim 1, wherein the core has an approximately circular or multisided shape in the cross section of the part provided with the ring member.

8. The induction heating and fixing device of claim 1, wherein the pressure member has a heating member therein.

9. An induction heating and fixing device comprising:

a hollow cylindrical fixing member heated by induction;

a core for forming a closed magnetic circuit, a part of the core being inserted onto the hollow cylindrical fixing member, the magnetic circuit near the bilateral ends of the fixing member being thicker than that of the other part;

a coil wound around the core; and a pressure member disposed so as to press against the hollow cylindrical fixing member.

10. The induction heating and fixing device of claim 9, wherein the fixing member comprises a hollow cylindrical conductive member and a releasing layer formed on the exterior surface of the hollow cylindrical conductive member.

11. The induction heating and fixing device of claim 9, wherein the pressure member has a heating member therein.

12. An image forming apparatus comprising:

an image forming unit for forming toner image on a recording medium; and an induction heating and fixing device for fixing the toner image on the recording medium;

wherein the induction heating and fixing device comprises a hollow cylindrical fixing member heated by induction; a core for forming a closed magnetic circuit, a part of the core being inserted onto the hollow cylindrical fixing member; a ring member formed of magnetic material and provided on the core in the vicinity of the bilateral ends of the hollow cylindrical fixing member; a coil wound around the core; and a pressure member disposed so as to press against the hollow cylindrical fixing member.

13. The image forming apparatus of claim 12, wherein the ring member has a slit which is provided along the axial direction of the fixing member.

14. The image forming apparatus of claim 12, wherein the magnetic material is at least one material selected from the group consisting of ferrite, pure iron and silicon steel.

15. The image forming apparatus of claim 12, wherein the ring member comprises a magnet material layer and an insulation layer and is formed in a spiral shape.

16. The image forming apparatus of claim 12, wherein the ring member has a taper at both end in the axial direction of the fixing member.

17. The image forming apparatus of claim 12, wherein the core has an approximately circular or multisided shape in the cross section of the part provided with the ring member.

18. The image forming apparatus of claim 12, wherein the fixing member comprises a hollow cylindrical conductive member and a releasing layer formed on the exterior surface oft e hollow cylindrical conductive member.

19. The image forming apparatus of claim 12, wherein the pressure member has a heating member therein.

* * * * *

UNITED STATES PATENT AND TRADEMARK OFFICE

CERTIFICATE OF CORRECTION

PATENT NO. : 6,661,991 B2
DATED : December 9, 2003
INVENTOR(S) : Yoshikazu Naito et al.

It is certified that error appears in the above-identified patent and that said Letters Patent is hereby corrected as shown below:

Column 8,
Line 4, change “oft e” to -- of the --.

Signed and Sealed this

Twenty-second Day of June, 2004

JON W. DUDAS
*Acting Director of the United States Patent and Trademark Office*